US006279618B1

(12) United States Patent
Speich et al.

(10) Patent No.: US 6,279,618 B1
(45) Date of Patent: Aug. 28, 2001

(54) DEVICE FOR SELECTING A THREAD IN A TEXTILE MACHINE AND TEXTILE MACHINE FITTED WITH SAID DEVICE

(75) Inventors: Francisco Speich, Gipf-Oberfrick; John Rush, Frick, both of (CH)

(73) Assignee: Textilma AG, Hergiswil (CH)

( * ) Notice: Subject to any disclaimer, the term of this patent is extended or adjusted under 35 U.S.C. 154(b) by 0 days.

(21) Appl. No.: 09/600,265

(22) PCT Filed: Nov. 23, 1999

(86) PCT No.: PCT/CH99/00560

§ 371 Date: Oct. 16, 2000

§ 102(e) Date: Oct. 16, 2000

(87) PCT Pub. No.: WO00/32859

PCT Pub. Date: Jun. 8, 2000

(30) Foreign Application Priority Data

Nov. 26, 1998 (DE) ..... 298 21 191 U

(51) Int. Cl.[7] ..... D03C 3/20
(52) U.S. Cl. ..... 139/59; 139/55.1
(58) Field of Search ..... 139/55.1, 59, 64, 139/65; 66/205, 207, 203, 209, 214, 204

(56) References Cited

U.S. PATENT DOCUMENTS 4,593,723 * 6/1986 Griffith ..... 139/65
4,936,357 * 6/1990 Keim et al. ..... 139/455
5,176,186 * 1/1993 Bousfield et al. ..... 139/455
5,309,952 * 5/1994 Speich ..... 139/455
5,373,871 * 12/1994 Speich ..... 139/455
5,675,993 * 10/1997 Ono et al. ..... 66/204

FOREIGN PATENT DOCUMENTS 4026187 12/1991 (DE) .
9814229 12/1998 (DE) .
0119787 9/1984 (EP) .
2047755 12/1980 (GB) .

* cited by examiner

*Primary Examiner*—Danny Worrell
(74) *Attorney, Agent, or Firm*—Sidley Austin Brown & Wood, LLP

(57) ABSTRACT

The apparatus comprises at least one movable member (1) for the reception of the thread, a coupling arrangement (2) and a winding (3) which produces a magnetic field and is intended to produce different polarities in the coupling arrangement through which the magnetic flux passes and to bring the coupling arrangement into engagement with the member. The member (1) consists of magnetic or non-magnetic material and the coupling arrangement (2) of ferromagnetic material.

The apparatus ensures a reliable coupling at high rhythm.

9 Claims, 1 Drawing Sheet

DEVICE FOR SELECTING A THREAD IN A TEXTILE MACHINE AND TEXTILE MACHINE FITTED WITH SAID DEVICE

BACKGROUND OF THE INVENTION

1. Field of the Invention

The present invention relates to an apparatus for selecting a thread in a textile machine and including a reciprocating member for picking up a thread, a holding element, a guide member, and means for producing a magnetic field acting on the holding element for displacing it in engagement with picking-up member.

2. Description of the Art

In the manufacture of textile structures, different threads are selected and/or moved for the patterning. In modern textile machines with high speeds of rotation the know apparatuses prove to be too complicated and/or too sluggish.

The invention is based on the object of improving an apparatus for the selection of a thread in a textile machine.

SUMMARY OF THE INVENTION

This and other objects of the present invention, which will become apparent hereinafter, are achieved by forming the guide member as a rigid element that limits the deflection of the holding element toward the picking-up member and prevents the free end of the holding member from engaging the picking-up member, and by generating a magnetic field such that it produces different polarities in the holding and rigid elements.

The advantages of the invention are to be seen essentially in the simple construction and the ensuring of a reliable coupling of the member and of the coupling arrangement and in the possibility of converting existing apparatuses.

BRIEF DESCRIPTION OF THE DRAWINGS

The objects and advantages of the present invention will become more apparent and the invention itself will be best understood from the following detailed description of the present invention when read with reference to the accompanying drawings, wherein.

DETAILED DESCRIPTION OF THE PREFERRED EMBODIMENTS

Figure 1:
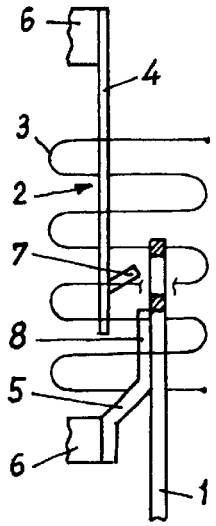
FIG. 1 a first embodiment of an apparatus in accordance with the invention.

FIG. 1 shows the basic principle of the invention under discussion here. The apparatus comprises essentially a bar 1, a coupling arrangement 2 and a winding 3, with it being assumed here that the bar 1 is movable to and fro and the coupling arrangement is arranged in a fixed position. The bar 1 consists of non-magnetic material, for example brass, and is movable to and fro along a path of movement. It is pointed out that the bar 1 can consist of magnetic material. The coupling arrangement 2 contains a bendable holding element 4 and a rigid element 5 which consists of a material with ferromagnetic characteristics. The bendable element 4 is a strip which is secured at one end to a holder 6 and has a hook 7 in the region of the other end. The rigid element 5 is S-shaped and so secured to the holder 6 that a section 8 projects beyond the free end of the strip 4. The winding 3 is so formed that it surrounds the bar 1 and the coupling arrangement 2.

In a non-illustrated modification of the coupling arrangement in accordance with FIG. 1 the bendable holding element 4 is arranged to be movable to and fro.

When the winding 3 is not excited the bar 1 is moved within winding 3 past the arrangement and can be guided in advantageous manner by the section 8 of the rigid element 5. When the winding 3 is excited a magnetic field is produced, whereby different polarities are produced in the bendable and rigid elements 4, 5 through which the magnetic flux passes, so that the bendable holding element 4 is drawn against the rigid element 5 by the magnetic force. The hook 7 is thereby displaced into the path of movement of the bar 1 so that it comes into engagement with the displaced holding element 4. As a result of the rigid element the advantages result that the deflection of the bar 1 as well as of the bendable element 4 is restricted and the hook 7 always adopts the same position relative to the bar 1, and that an overshooting of the bendable element is prevented.

Figure 2:
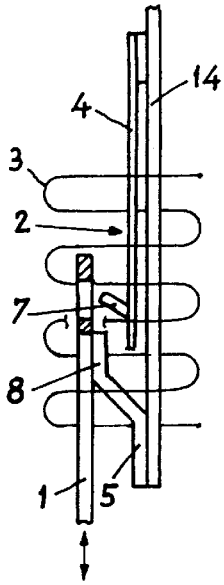
FIG. 2 a second embodiment of an apparatus in accordance with the invention.

As FIG. 2 shows the apparatus includes a bar 1 and a carrier member 14 with the coupling arrangement 2 which are movable to and fro along parallel paths of movement as well as the winding 3 which is so arranged in a fixed position that is surround the paths of movement of the bar 1 and of the carrier member 14 with the coupling arrangement 2. The bar 1 consists of a non-magnetic material. The carrier member 14 consists of non-magnetic material. The coupling arrangement 2 is installed on the carrier member and contains the bendable holding element 4 and the rigid element 5. The bendable holding element 4 is secured at one end to the carrier member 14. The rigid element 5 is so secured to the carrier member 14 that the section 8 extends parallel to the carrier member and projects beyond the free end of the bendable holding element 4.

In this apparatus the bar 1 are moved to and fro in opposite directions along parallel paths of movement. The coupling of the bar 1 and the carrier member 14 with the coupling arrangement 2 takes place within the winding 3. The process of the coupling takes place essentially in the same way as in the apparatus of FIG. 2. If the winding 3 is excited, then the bendable holding element 4 is drawn against the rigid element 5 and is displaced into the path of movement of the bar 1 and comes into engagement with the bar 1.

Figure 3:
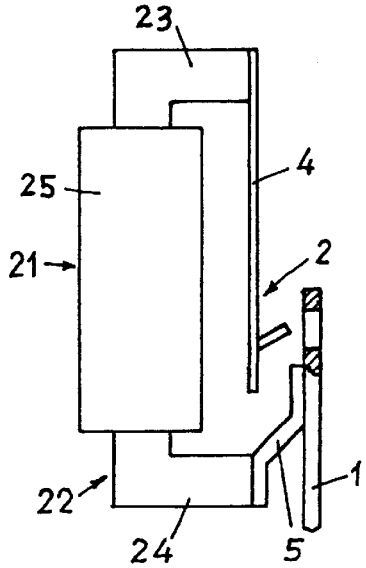
FIG. 3 a modification of the embodiment of FIG. 1.
Figure 4:
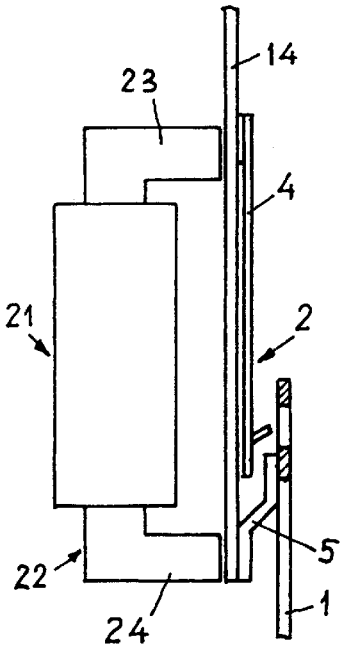
FIG. 4 a further embodiment of an apparatus in accordance with the invention.

FIG. 3 shows an embodiment which is distinguished from that of FIG. 1 in that an electromagnet 21 is provided in place of the winding 3. The electromagnet 21 consist of a U-shaped core 22 with two limbs 23, 24 and a winding 25. The electromagnet 21 is so arranged that the end faces of the limbs are parallel to the path of movement of the bar 1. The coupling arrangement 2 is so connected to the core 22 of the electromagnet 21 that the bendable holding element 4 and the rigid element 5 are respectively connected to a different 23, 24.

The embodiment shown in FIG. 24 is distinguished from that of FIG. 2 in that an electromagnet 21 is provided in place of the winding 3. In this case the electromagnet 21 is so arranged that the end faces of the limbs 23, 24 are arranged spaced apart from and parallel to the path of movement of the bar 1 and of the coupling arrangement 2.

It is advantage, when the core 21 of the electromagnet consists of a soft magnetic material with a saturation magnetization greater than 1,5 tesla.

The manner of operation of this embodiment is the same than that of FIG. 1 and will thus not be described.

Figure 5:
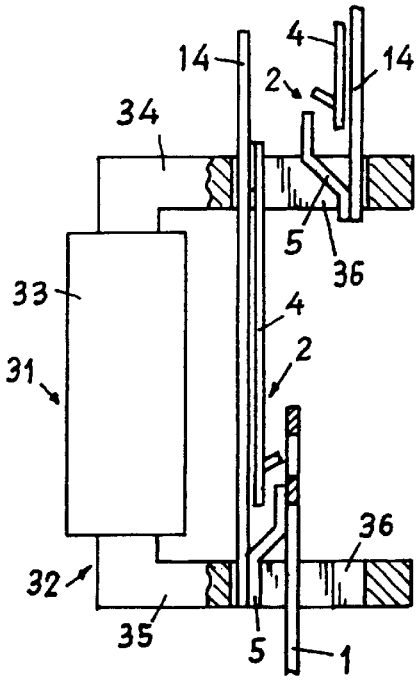
FIG. 5 a modification of the embodiment of FIG. 3.

The embodiment shown in FIG. 5 comprises a bar 1, two carrier members 14 with the coupling arrangement 2 and an electromagnet 31. The bar 1 is movable to and fro along a first path of movement and the carrier members 14 with the coupling arrangement 2 are movable to and fro in opposite senses along two paths of movement which are parallel to the first path of movement. The electromagnet 31 contains a core 32 and a winding 33. The core of the electromagnet has two limbs 34, 35 each with a cut-out 36 which at least partly surround the coupling arrangements.

Figure 6:
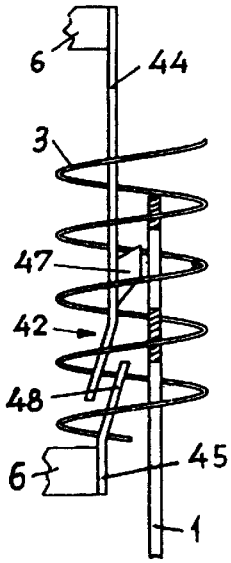
FIG. 6 a modified embodiment of a coupling arrangement.

FIG. 6 shows a modified embodiment of the coupling arrangement 42 which contains a bendable holding element 44 with a hook 47 and an angled section as well as a rigid element 45 with an angled section 48. This coupling arrangement 42 can likewise be used in the above described embodiments, with the function being identical.

The apparatus comprises at least on movable member 1 for the reception of the thread, a coupling arrangement 2 and a winding 3 which produces a magnetic field and is intended to produce different polarities in the coupling arrangement through which the magnetic flux passes and to bring the coupling arrangement into engagement with the member. The member 1 consists of non-magnetic material and the coupling arrangement 2 consists of ferromagnetic material. The apparatus ensures a reliable coupling at high rhythm.

What is claimed is:

1. An apparatus for selecting a thread in a textile machine, comprising a least one reciprocating member for picking up the thread and formed of one of magnetic material and non-magnetic material; coupling means including a bendable holding element displaceable in and out of engagement with the picking-up member, and a rigid element formed of a ferro-magnetic material; and means for producing a magnetic field which provides for bending of the holding element toward the picking-up member, wherein the picking-up member and the holding element have complementary, engageable each other sections, wherein the rigid element has a section located between the holding element and the picking-up member and extending in a direction opposite a direction in which a free end of the holding element extends, the section of the rigid element projecting beyond the free end of the holding element for limiting deflection of the holding element in a direction toward the picking-up member and for keeping the free end of the holding element at a distance from the picking-up member, and wherein the holding element and the rigid element have different polarities when subjected to action of the magnetic field.

2. An apparatus according to claim 1, wherein the section of the rigid elements serves for guiding the picking-up member.

3. An apparatus according to claim 1, wherein the holding and rigid elements are fixedly secured.

4. An apparatus according to claim 1, wherein the holding and rigid elements are supported for a reciprocating movement.

5. An apparatus according to claim 4, further comprising a reciprocating carrier member formed of non-magnetic material, wherein an end of the holding element opposite the free end thereof is fixedly secured to the carrier member, wherein the carrier member has an end section projection beyond the free end of the holding element, and wherein the rigid element is secured to the projecting end section of the carrier member, and the section of the rigid element extends parallel to the carrier member.

6. An apparatus according to claim 1, wherein the magnetic field producing means comprises at least one winding surrounding the picking-up member and the holding and rigid elements.

7. An apparatus according to claim 1, wherein the magnetic field producing means comprises an electromagnet having a core with two limbs, and wherein the holding element is connected with one limb and the rigid element is connected with another limb.

8. An apparatus according to claim 7, wherein the core is formed of a soft magnetic material with a saturation magnetization greater than 1.5 tesla.

9. An apparatus according to claim 1, comprising further coupling means mirrow-inverted with respect to the coupling means, wherein both coupling means arranged parallel to path of movement of the picking-up means, and wherein holding elements of the two coupling means are mirrow-inverted with respect to each other.

* * * * *